US005242050A

United States Patent [19]

Billings

[11] Patent Number: 5,242,050

[45] Date of Patent: Sep. 7, 1993

[54] ARCHERY TACKLE BOX

[76] Inventor: Scott A. Billings, 10011 58th Ave. East Court, Puyallup, Wash. 98373

[21] Appl. No.: 915,323

[22] Filed: Jul. 20, 1992

[51] Int. Cl.[5] ..... B65D 85/00

[52] U.S. Cl. ..... 206/315.11; 206/315.1; 206/579; 206/372; 206/373; 224/916

[58] Field of Search ..... 206/315.1, 315.11, 372, 206/373, 375, 579; 220/521, 522; 224/916

[56] References Cited

U.S. PATENT DOCUMENTS

| | | | |
|---|---|---|---|
| 417,979 | 12/1889 | Borcherdt | 220/522 |
| 1,614,910 | 1/1927 | Yarder | 206/373 |
| 2,334,839 | 11/1943 | Purchas | 206/372 |
| 2,501,879 | 3/1950 | Sulentic | 206/373 |
| 2,522,213 | 9/1950 | Doniger | 206/375 |
| 2,673,783 | 3/1954 | Rahm et al. | 220/522 |
| 2,964,166 | 12/1960 | Lehner et al. | 206/579 |
| 3,337,028 | 8/1967 | Glavan | 206/315.11 |
| 3,348,329 | 10/1967 | Seemann | 206/315.11 |
| 3,399,009 | 8/1986 | Slade | 206/315.11 |
| 4,150,746 | 4/1979 | Buglione | 206/372 |
| 4,170,801 | 10/1979 | Ward | 206/315.11 |
| 4,714,158 | 12/1987 | Oltman et al. | 206/372 |
| 5,011,013 | 4/1991 | Meisner et al. | 206/373 |

FOREIGN PATENT DOCUMENTS

| | | | |
|---|---|---|---|
| 2603173 | 3/1988 | France | 206/315.11 |

*Primary Examiner*—David T. Fidei
*Attorney, Agent, or Firm*—Leon Gilden

[57] ABSTRACT

A box assembly arranged to secure various arrow shafts therewithin, as well as accessory tools and the like, includes a container body having pivotally mounted thereto a lid body, with the lid body including spaced front and rear lid walls accommodating first and second support assemblies interconnected by a support length that in turn is selectively secured to the lid front wall by a latch member. The support assemblies are arranged to secure plural rows of archery arrows therebetween. The container body is arranged to receive a tray member that is further configured to accommodate various accessory components therewithin.

5 Claims, 4 Drawing Sheets

ARCHERY TACKLE BOX

BACKGROUND OF THE INVENTION

1. Field of the Invention

The field of invention relates to archery apparatus, and more particularly pertains to a new and improved archery tackle box wherein the same is arranged to accommodate various components for use in an archery event.

2. Description of the Prior Art

Archery apparatus of various types are utilized throughout the prior art, but typically the accommodating of various components for use in archery is accommodated by containers of limited use, wherein the instant invention attempts to address deficiencies of the prior art by providing for a tackle box arranged to receive tools and the like therewithin for use in archery, as well as maintaining archery arrows in a spaced relationship relative to one another to prevent damage during their transport prior to use. Prior art tackle box type structure to accommodate components utilizing spaced leg members is exemplified in the U.S. Pat. Nos. 254,122 and 300,183.

Accordingly, it may be appreciated there continues to be a need for a new and improved archery tackle box which addresses both the problems of ease of use as well as effectiveness in construction and in this respect, the present invention substantially fulfills this need.

SUMMARY OF THE INVENTION

In view of the foregoing disadvantages inherent in the known types of archery apparatus now present in the prior art, the present invention provides an archery tackle box wherein the same is arranged to secure and maintain various components for use in an archery event. As such, the general purpose of the present invention, which will be described subsequently in greater detail, is to provide a new and improved archery tackle box which has all the advantages of the prior art archery container structure and none of the disadvantages.

To attain this, the present invention provides a box assembly arranged to secure various arrow shafts therewithin, as well as accessory tools and the like, including a container body having pivotally mounted thereto a lid body, with the lid body including spaced front and rear lid walls accommodating first and second support assemblies interconnected by a support length that in turn is selectively secured to the lid front wall by a latch member. The support assemblies are arranged to secure plural rows of archery arrows therebetween. The container body is arranged to receive a tray member that is further configured to accommodate various accessory components therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery tackle box which has all the advantages of the prior art archery container apparatus and none of the disadvantages.

It is another object of the present invention to provide a new and improved archery tackle box which may be easily and efficiently manufactured and marketed.

It is a further object of the present invention to provide a new and improved archery tackle box which is of a durable and reliable construction.

An even further object of the present invention is to provide a new and improved archery tackle box which is susceptible of a low cost of manufacture with regard to both materials and labor, and which accordingly is then susceptible of low prices of sale to the consuming public, thereby making such archery tackle boxes economically available to the buying public.

Still yet another object of the present invention is to provide a new and improved archery tackle box which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
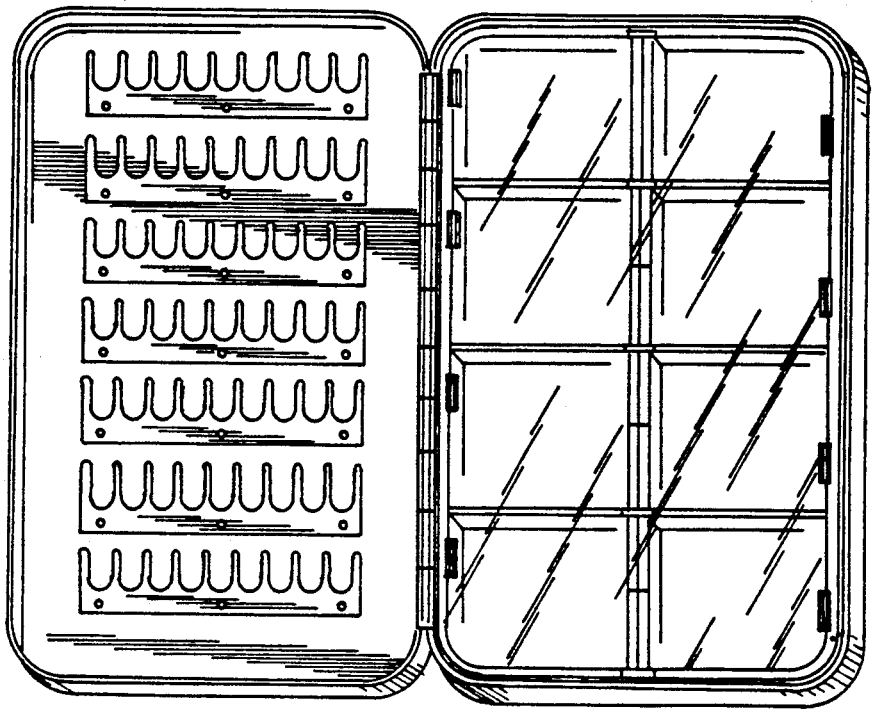
FIG. 1 PRIOR ART
FIG. 1 is an orthographic view of a prior art container, as indicated in the U.S. Pat. No. 254,122.
Figure 2:
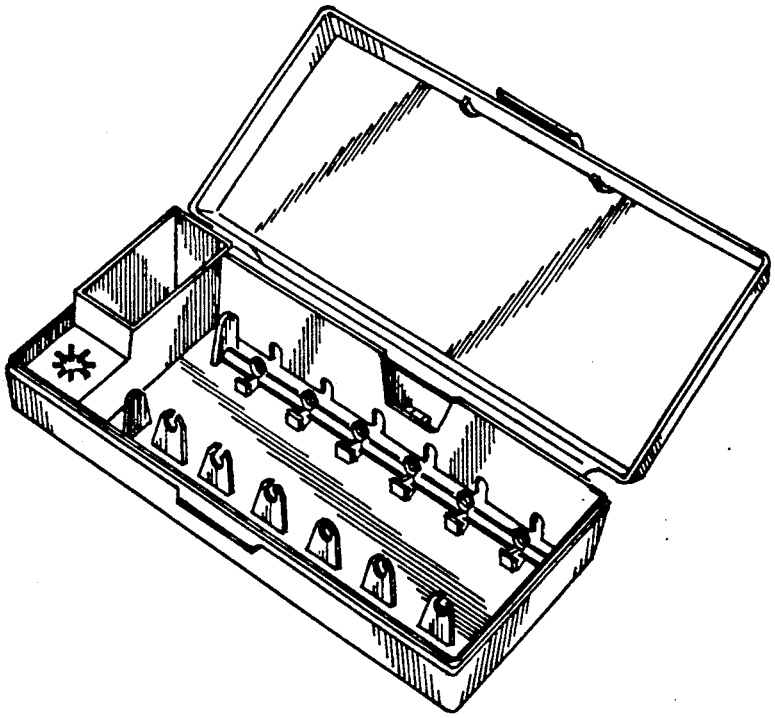
FIG. 2 PRIOR ART
FIG. 2 indicates an isometric illustration of a prior at hunter archery accessory box, as indicated in U.S. Pat. No. 300,183.

With reference now to the drawings, and in particular to FIGS. 1 to 7 thereof, a new and improved archery tackle box embodying the principles and concepts of the present invention and generally designated by the reference numerals 10 and 10*a* will be described.

More specifically, the archery tackle box 10 of the instant invention essentially comprises a container body 11 having a container floor 12, a container first side wall 13 spaced from a container second side wall 14, with a container front wall 15 spaced from a container rear wall 16. A lid body 17 is hingedly mounted to the container body at a container continuous upper edge 26 of the container body, with the lid body 17 including a lid rear wall 18 spaced from a lid front wall 22, a lid top wall 19 having a lid handle 34 mounted thereon and a lid first side wall 20 spaced from a lid second side wall 21. Hinge members 23 hingedly mount the lid rear wall 18 to the container rear wall 16 at the continuous upper edge 26. First latch members 24 secured to the container front wall 15 at the upper edge 26 cooperate with second latch members 25 mounted to the lid front wall to secure the lid body 17 to the container body 11 during transport of the organization. A tray member 27 is arranged for positioning with the container body. The tray member 27 includes a tray member continuous side wall 28 having a tray floor 29. A tray side wall flange 30 orthogonally mounted to an upper edge of the tray continuous side wall 28 is arranged for reception and positioning upon the continuous upper edge 26 to secure and position the tray member 27 within the organization.

Figure 3:
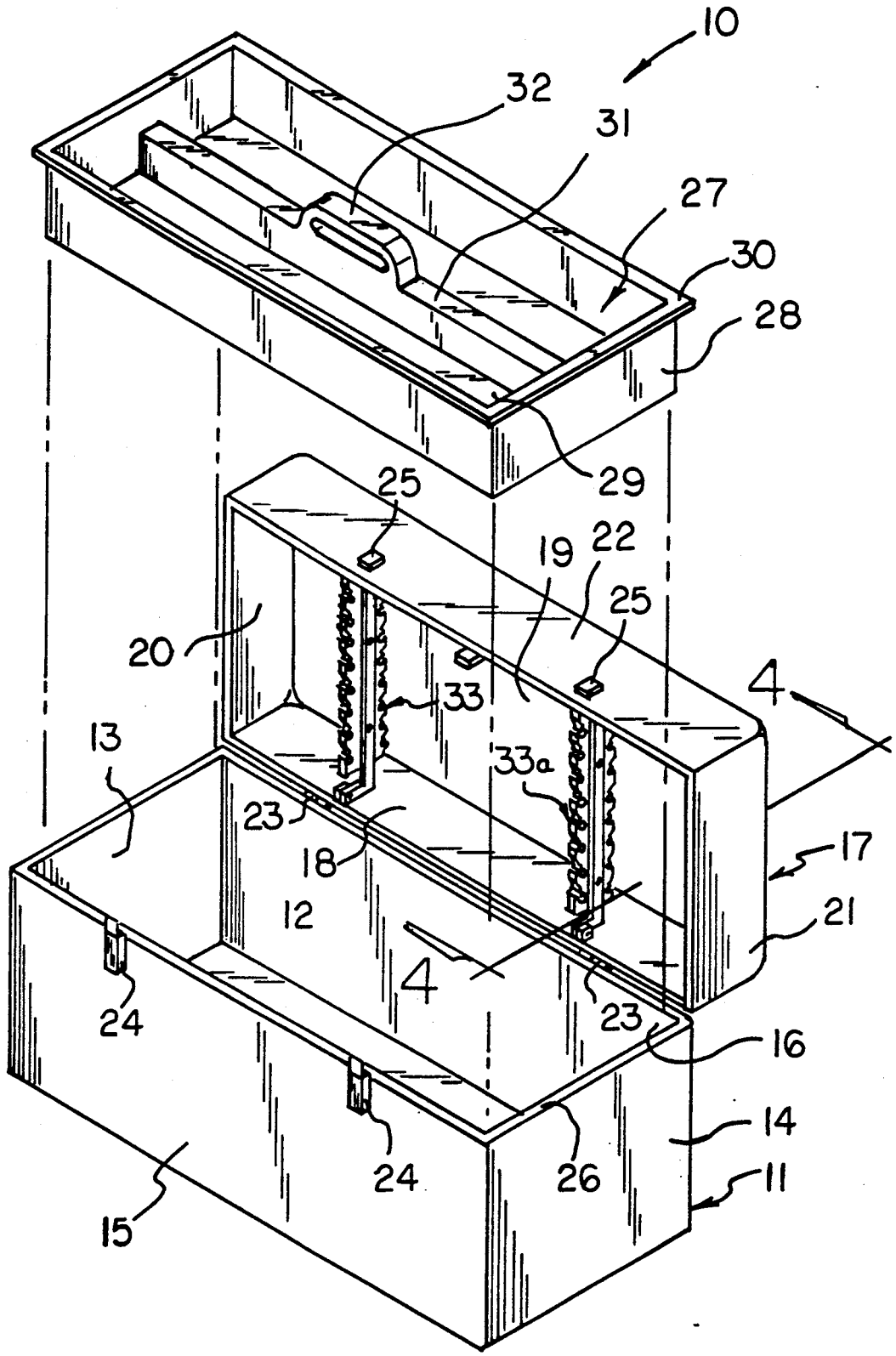
FIG. 3 is an isometric illustration of the invention with the tray member separated from the container body.
Figure 4:
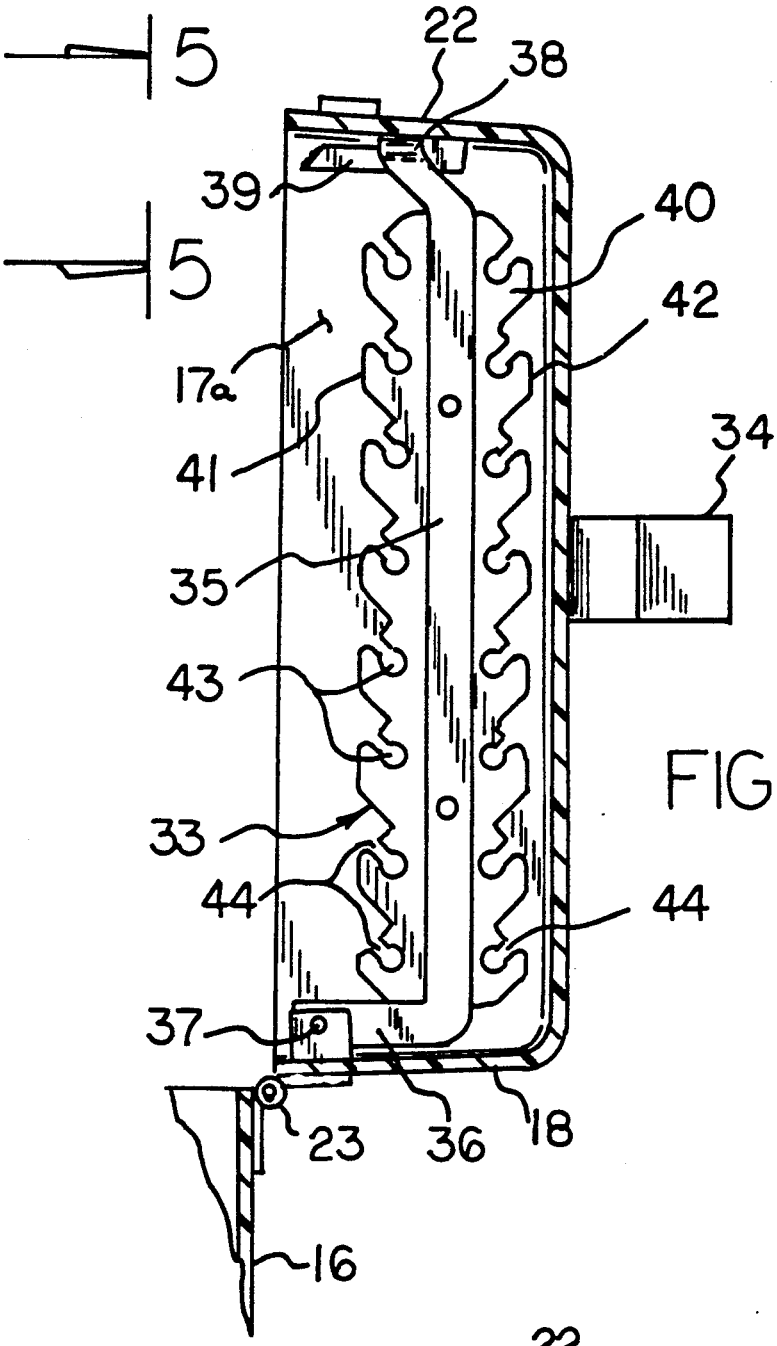
FIG. 4 is an orthographic view, taken along the lines 4—4 of FIG. 3 in the direction indicated by the arrows.
Figure 5:
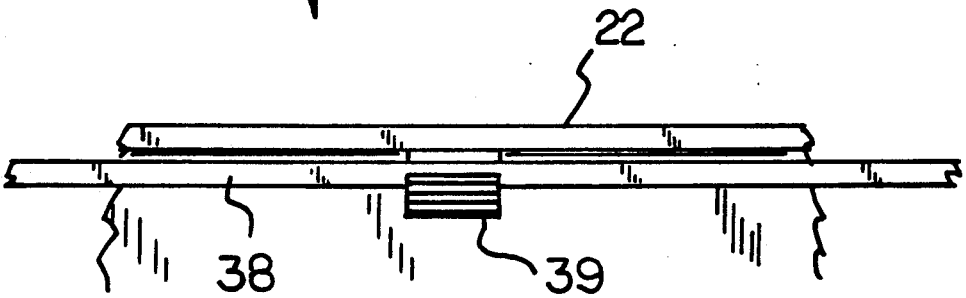
FIG. 5 is an orthographic view, taken along the lines 5—5 of FIG. 4 in the direction indicated by the arrows.
Figures 6, 7:
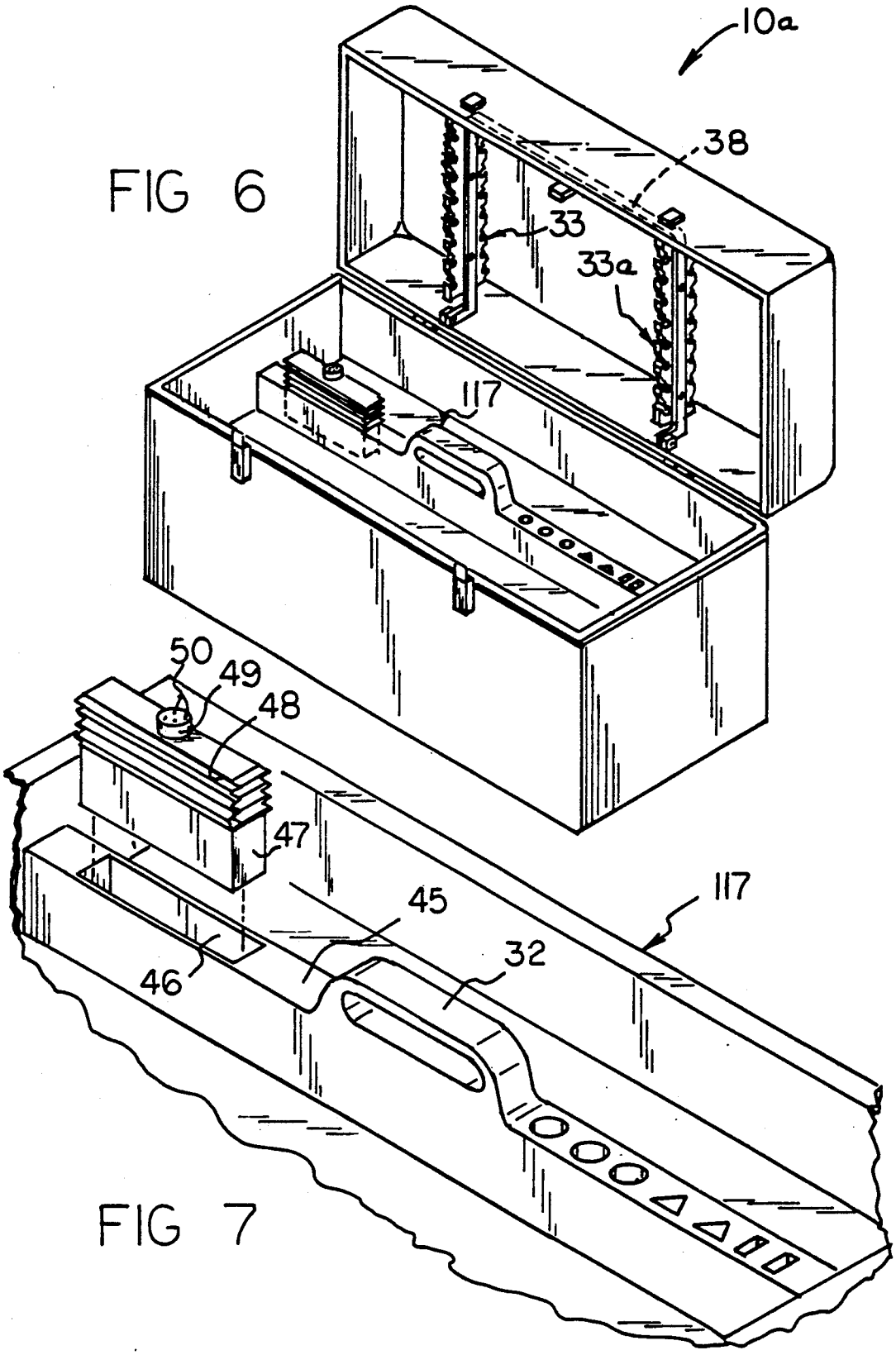
FIG. 6 is an isometric illustration of a modified tray member utilized by the invention.
FIG. 7 is an enlarged isometric illustration of the tray member utilized by the organization, as set forth in FIG. 6.

A first and second support assembly 33 and 33*a* respectively is pivotally mounted within the lid body 17, as indicated in the FIGS. 3 and 4 for example. The first and second support assemblies 33 and 33*a* each include a support link 35 having a support link first leg 36 orthogonally mounted integrally to a rear distal end of each support leg 35, with each first leg 36 secured to a pivot axle 37 mounted to the lid body's rear wall 18. A forward distal end of the support link 35 includes a connecting bar 38 orthogonally and integrally interconnecting the forward distal ends of the support links 35 of each of the first and second support assemblies 33 and 33*a*. A connecting bar latch 39 (see FIG. 5 for example) mounted to an interior surface of the lid front wall 22 is arranged to engage the connecting bar 38 and selectively release the connecting bar to permit pivotment of the connecting bar and the associated first and second support assemblies 33 and 33*a* as a unit for within the lid body, and more specifically, the lid body cavity 17*a* for access to arrows, and more specifically, plural rows of arrows directed and secured orthogonally between the first and second support assemblies 33 and 33*a*. To this end, each support link 35 coextensively mounts a resilient quaver support plate 40 having a support plate first side and a support plate second side 41 and 42 respectively on opposed sides of each respective support link 35. The support plate first and second sides 41 and 42 include each a row of side wall slots 44 in communication with the first and second sides 41 and 42, with the side wall slots 44 directed into a semi-cylindrical recess 43 within the resilient support plate 40 to receive an arrow shaft (not shown) between coaxially aligned semi-cylindrical recesses 43 of the respective first and second support assemblies 33 and 33*a*.

Further, a modified tray 117 is provided, with the tray having in addition to the tray central rib 31 mounted medially and orthogonally to the tray floor 29, a rib top wall 45 having a first cavity 46 on a first side of the rib handle 32. Within the first cavity 46 is a fluid reservoir 47 having a reservoir bellows 48 mounted to an upper end of the fluid reservoir, with the bellows having a bellow fill cap 49, with the bellows fill cap having a plurality of cap apertures 50 directed therethrough, whereupon depressing the bellows 48 directs fluid and typically a scented fluid such as deer attractant and the like for dispensing. A row of rib top wall arrow head cavities 57 mounted to a second side of the rib handle 32 is arranged to secure various configurations of arrow heads safely within the arrow head cavities 51.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships of the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery tackle box, comprising, a container body, the body including a body floor, a body first side wall spaced from a body second side wall, a body front wall spaced from a body rear wall, with the container floor, the container first side wall, the container second side wall, the container front wall, and container rear wall having a continuous upper edge, and a container cavity oriented within the container body, and a lid body, the lid body having a lid body rear wall, a lid body top wall, a lid body first side wall, and a lid body second side wall, with a lid front wall spaced from the lid rear wall, and having a lid cavity defined within the lid body between the lid rear wall, lid front wall, lid first side wall, lid second side wall, and lid top wall, and a lid handle mounted to the top wall, and at least one hinge mounted to the continuous upper edge and to the lid rear wall to pivotally mount the lid body to the container body, and the container front wall having at least one first latch member, and the lid front wall having at least one second latch member, wherein the first latch member and second latch member are cooperative to secure the lid body to the container body, and a tray member, the tray member having a continuous tray side wall and a tray floor, with the tray side wall received within the container body, and the tray member having a tray side wall flange orthogonally mounted to an upper end of the tray side wall, wherein the side wall flange is arranged for abutment with the continuous upper edge, and a tray floor central rib fixedly mounted to the tray floor, with the central rib having a rib handle, and the container cavity includes a first support assembly and a second support assembly, each support assembly includes a support link, each support link includes a support link first leg orthogonally mounted to the support link first end, with each first leg having a first leg pivot axle mounted to the first leg and to the lid rear wall to pivotally mount each support link to the lid rear wall, and each support link having a support link second end, and each second end including a connecting bar orthogonally mounted to each support link second end of the respective first and second support assembly interconnecting the first support assembly and second support assembly to unitarily pivot the first support assembly and the second support assembly relative to the lid cavity.

2. A box as set forth in claim 1 wherein the lid front wall includes a connecting bar latch mounted to the lid front wall within the lid cavity, and the connecting bar latch receiving the connecting bar in a first position, with the connecting bar positioned within the lid cavity, and permitting release of the connecting bar when the connecting bar is pivoted exteriorly of the lid cavity.

3. A box as set forth in claim 2 wherein each support link includes a resilient quaver support plate, and each quaver support plate includes a first side and a second side on opposed sides of the quaver support plate, wherein the first side and the second side include respective first side and second side semicylindrical recesses directed into the support plate through the respective first side and second side, and the first side recesses include first side wall slots communicating each first side wall recess with the first side, and each of the second side wall recesses include a second side wall slot communicating the second side wall recesses with the second side of the support plate, wherein first side wall recesses define a first row and the second side wall recesses define a second row, and the first row is arranged parallel to the second row, and the support plate of the first and second support assemblies are arranged to received arrow shafts therebetween.

4. A box as set forth in claim 3 wherein the tray floor central rib includes a rib top wall, the rib top wall includes a first cavity positioned on a first side of the rib handle, and the first cavity includes a fluid reservoir slidably mounted within the first cavity, wherein the fluid reservoir includes a fluid reservoir bellows mounted to an upper end of the fluid reservoir, and the reservoir bellows includes a bellows cap mounted to an upper end of the bellows, and the bellows cap includes a plurality of cap apertures directed through the bellows cap, whereupon compressing of the bellows against the fluid reservoir permits projection of fluid contained within the fluid reservoir through the cap apertures.

5. A box as set forth in claim 4 wherein the rib top wall includes a row of rib top wall arrow head cavities directed into the rib top wall on a second side of the rib handle, and each arrow head cavity of said arrow head cavities is arranged to receive an individual arrow head therewithin.

* * * * *